US007066251B2

(12) United States Patent
Streater et al.

(10) Patent No.: US 7,066,251 B2
(45) Date of Patent: Jun. 27, 2006

(54) HYDRAULIC JAR LOCK

(75) Inventors: James R. Streater, Humble, TX (US); Donald L. Leach, Houston, TX (US)

(73) Assignee: National-Oilwell, L.P., Houston, TX (US)

( * ) Notice: Subject to any disclaimer, the term of this patent is extended or adjusted under 35 U.S.C. 154(b) by 132 days.

(21) Appl. No.: 10/427,773

(22) Filed: May 1, 2003

(65) Prior Publication Data

US 2004/0216869 A1 Nov. 4, 2004

(51) Int. Cl.
*E21B 31/113* (2006.01)

(52) U.S. Cl. ..... 166/178; 175/296; 175/304

(58) Field of Classification Search ..... 166/178, 166/301, 242.7, 242.6; 175/301, 296, 299, 175/300, 304

See application file for complete search history.

(56) References Cited

U.S. PATENT DOCUMENTS

| | | | | |
|---|---|---|---|---|
| 3,570,598 | A * | 3/1971 | Johnson | 166/178 |
| 4,511,007 | A | 4/1985 | Jung et al. | 175/297 |
| 4,660,637 | A | 4/1987 | McGill et al. | 166/120 |
| 4,662,460 | A | 5/1987 | Loeb et al. | 175/305 |
| 4,671,361 | A | 6/1987 | Bolin | 166/377 |
| 4,862,957 | A | 9/1989 | Scranton | 166/51 |
| 4,984,632 | A | 1/1991 | Sampa et al. | 166/237 |
| 5,074,361 | A | 12/1991 | Brisco et al. | 166/301 |
| 5,170,843 | A * | 12/1992 | Taylor | 166/301 |
| 5,526,888 | A * | 6/1996 | Gazewood | 175/320 |
| 6,173,786 | B1 | 1/2001 | Sampson et al. | 166/383 |
| 6,202,767 | B1 | 3/2001 | Friis | 175/297 |
| 6,338,387 | B1 * | 1/2002 | Mouton et al. | 166/301 |
| 6,408,946 | B1 | 6/2002 | Marshall et al. | 166/317 |
| 6,439,305 | B1 * | 8/2002 | Bakke | 166/242.6 |
| 6,527,048 | B1 | 3/2003 | Trosclair | 166/242.7 |
| 6,540,025 | B1 * | 4/2003 | Scott et al. | 166/355 |

FOREIGN PATENT DOCUMENTS

| | | |
|---|---|---|
| EP | 0 409 446 | 7/1990 |
| EP | 1024249 | 8/2000 |

OTHER PUBLICATIONS

European Search Report for EP Appln. No. 04252454.6, dated Aug. 30, 2004 (2 p.).

* cited by examiner

*Primary Examiner*—Kenneth Thompson
(74) *Attorney, Agent, or Firm*—Conley Rose, P. C.

(57) ABSTRACT

An internal, positive engagement lock that locks a tool, such as a hydraulic drilling jar, in the fully open position when the tool is racked back and when tripping in and out of the hole close to the surface. The lock mechanism is spring biased into a locked position that provides a positive engagement between two axially translatable components, thus preventing any actuation of the tool. As the tool is run in the hole, increasing hydrostatic pressure within the tool will cause the locking mechanism to shift to a disengaged position and the tool will operate normally. The spring-biased locking mechanism will return to the locked position as hydrostatic pressure decreases as the tool is retrieved to the surface.

30 Claims, 5 Drawing Sheets

HYDRAULIC JAR LOCK

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This disclosure relates to borehole tools and apparatus, such as those used in drilling oil and gas wells. More particularly, it relates to drilling jars and to methods and apparatus for providing a mechanical lock that prevents a drilling jar from actuating. More particularly, the embodiments described herein provide a lock that is integrated into the drilling jar and that automatically locks and unlocks.

Jars are mechanical devices used downhole in a wellbore to deliver an impact load to the drilling string or to another downhole component, especially when that component is stuck. Jars may be designed for drilling or fishing applications, are generally available as hydraulically or mechanically actuated, and can be designed to strike upward, downward, or both. While their respective designs can be quite different, their operation is similar in that energy stored in the drillstring is suddenly released when the jar is actuated, known as tripping or firing.

In the case of "jarring up" at a location above a bottomhole assembly (BHA) that is stuck, the driller slowly pulls up on the drillstring but the BHA, because it is stuck, does not move. Since the top of the drillstring is moving up, the drillstring itself is stretching and storing energy. When the jar fires, one section of the jar is allowed to suddenly move axially relative to a second until the moving section impacts a steel shoulder formed on the stationary section of the jar, thereby imparting an impact load on the drillstring.

Many jar designs include a tripping or firing mechanism that prevents the jar from operating until the desired tension is applied to the string. Such jars are designed to be reset by simple drill string manipulation, and are thus capable of repeated operation, or firing, before being recovered from the well.

Before a jar is run into a well, while the jar is being stored on the drill floor, or after it is retrieved, it is often desirable to have a mechanism available to lock the jar into an open position to prevent unintentional firing, which can cause injury to personnel on the rig floor. Keeping the tool locked in the open position can also prevent accidental loss of the tool string downhole or damage to rig, which might result from the unintentional firing of the tool. Current solutions to this problem include the use of an internal mechanical latch and/or an external safety collar.

The conventional mechanical latch is set to release at a specific load in order to prevent unintentional firing while running the drilling assembly tripping into or out of the hole, i.e. tripping. When the predetermined latch release load is applied to the jar, the latch releases and the jar can be used as desired. One drawback of many of these internal latches is that every time the tool is stroked back, or reset, to the initial position, the latch is re-engaged. In order to release the latch, the release load must again be applied to the jar, creating additional steps in the procedure used to fire the jar. Another drawback of many mechanical latch designs is that, since the latch is designed to unlatch at a specified load, if the load is exceeded unintentionally, such as by the jar being handled improperly on the rig floor, the jar is configured to stroke and/or fire.

The typical external safety collar, also known as a "dog collar," consists of a two-piece sleeve with a lock that attaches to an exposed portion of the jar and keeps the tool from closing. The collar is designed to support any possible amount of weight above the jar as well that may be applied during storage on the rig floor. These external safety collars generally work as intended, and are currently being utilized in the field, but there are problems associated with their use.

Due to the rigors of use and possible mishandling, the external safety collars may get damaged and/or worn, possibly causing the safety collar to not fully latch. This damage may make the collar difficult to install on the tool or can potentially cause the collar to unlatch and fall from the tool. On a drilling rig, the collar may be stored well above the rig floor, such as a height of approximately 30 ft to 90 ft above the rig floor. Obviously, a heavy collar falling from this height puts the personnel and equipment on the rig floor at risk. Recognizing this risk, some drilling companies are requiring a backup safety strap be added to the safety collars, insuring that the collar cannot fall off accidentally. Unfortunately, securing an additional safety strap increases the time needed to secure the tool.

Another drawback to the external safety collar is that the collar must be installed on the jar each time that it is pulled from the hole, and then must be removed before the tool is run again. Therefore, the collar is another piece of separate drilling equipment that must be maintained and stored on the rig. There is also a risk that rig floor personnel may forget to remove the safety collar before running the tool into the well. Running the jar with the safety collar installed will prevent operation of the jar and can cause the jar to get stuck in the hole, necessitating a costly procedure to extricate the stuck tool.

Therefore, the embodiments of the present invention are directed to methods and apparatus for providing for a positive lock mechanism for a drilling jar that seeks to overcome certain of the limitations or drawbacks of the prior art.

SUMMARY OF THE PREFERRED EMBODIMENTS

The preferred embodiments provide a hydraulic drilling jar having an internal positive engagement lock that locks the tool in the fully open position when the tool is racked back and when tripping in and out of the hole close to the surface. The lock mechanism is spring biased into a locked position that provides a positive engagement preventing any actuation of the tool. As the jar is run in the hole, increasing hydrostatic pressure within the tool will cause the locking mechanism to shift to a disengaged position and the tool will operate normally. As the tool is returned to the surface and the hydrostatic pressure decreases, the spring-biased locking mechanism will return to the locked position.

In one preferred embodiment, the lock mechanism includes a plurality of lock segments having a locked position where the tool is locked open and a retracted position that allows actuation of the tool. The lock segments are supported by a piston sealingly engaged with a hydraulically isolated chamber. One or more biasing springs are disposed within the chamber and provide a force that biases the piston and segments into the locked position. As the hydrostatic pressure within the tool increases, it exceeds the pressure within the isolated chamber and pushes the piston into the chamber, compressing the biasing springs and shifting the lock segments to the unlocked position.

In one embodiment, the locking apparatus comprises an outer body and a sleeve disposed within and slidable relative to the outer body. An annular cavity is formed between the outer body and the sleeve and maintained at ambient pressure. A piston is sealingly engaged with the cavity and connected to a plurality of lock segments. Certain embodiments include three or more lock segments. The lock segments have a first position that prevents the sleeve from axially translating in at least one direction relative to the outer body, and a second position allowing axial translation. The cavity also contains a spring to bias the piston and lock segments to the first position. In certain embodiments, the biasing spring is a series of belleville springs. The lock segments are moved to the second position by pressure within the outer body. In the first position, a shoulder on the sleeve engages a concave surface on the lock segments where, in certain embodiments, the shoulder and the surface are at an angle of 45 degrees or less from horizontal. Also in the first position, a horizontal bearing surface on the lock segments engages a horizontal seat on the outer body.

In another preferred embodiment, a downhole tool comprises a body and an axially translatable sleeve disposed within the body. The tool also comprises a locking mechanism that has a locked position preventing axial translation of the sleeve relative to the body and a spring biasing the locking mechanism to the locked position. The locking mechanism is unlocked by hydrostatic pressure within the tool. In certain embodiments, the locking mechanism includes a piston disposed in an annular cavity, which is formed between the body and the sleeve and maintained at ambient pressure. The piston is connected to a plurality of lock segments, preferably at least three lock segments, that engage the sleeve and the body to prevent relative axial translation in at least one direction.

In another preferred embodiment, a locking mechanism is disposed on a drilling jar comprising an outer body and an inner sleeve adapted to translate axially relative to the outer body. The drilling jar may preferably be a single or double-acting hydraulic drilling jar. The locking mechanism has a locked position preventing the axial translation of the inner sleeve in at least one direction, and an unlocked position where axial translation is allowed. The locking mechanism comprises a spring adapted to bias the locking mechanism to the locked position and a piston adapted to move the locking mechanism to the unlocked position in response to pressure within the drilling jar. The spring and piston are designed such that when the jar is at or near the surface, the lock is automatically engaged, thus preventing unexpected actuation of the jar. The locking mechanism unlocks the tool once it reaches a selected depth in the wellbore and allows normal usage of the jar.

Thus, the present invention comprises a combination of features and advantages that enable it to provide for an automatically actuating, positively engaging locking apparatus. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
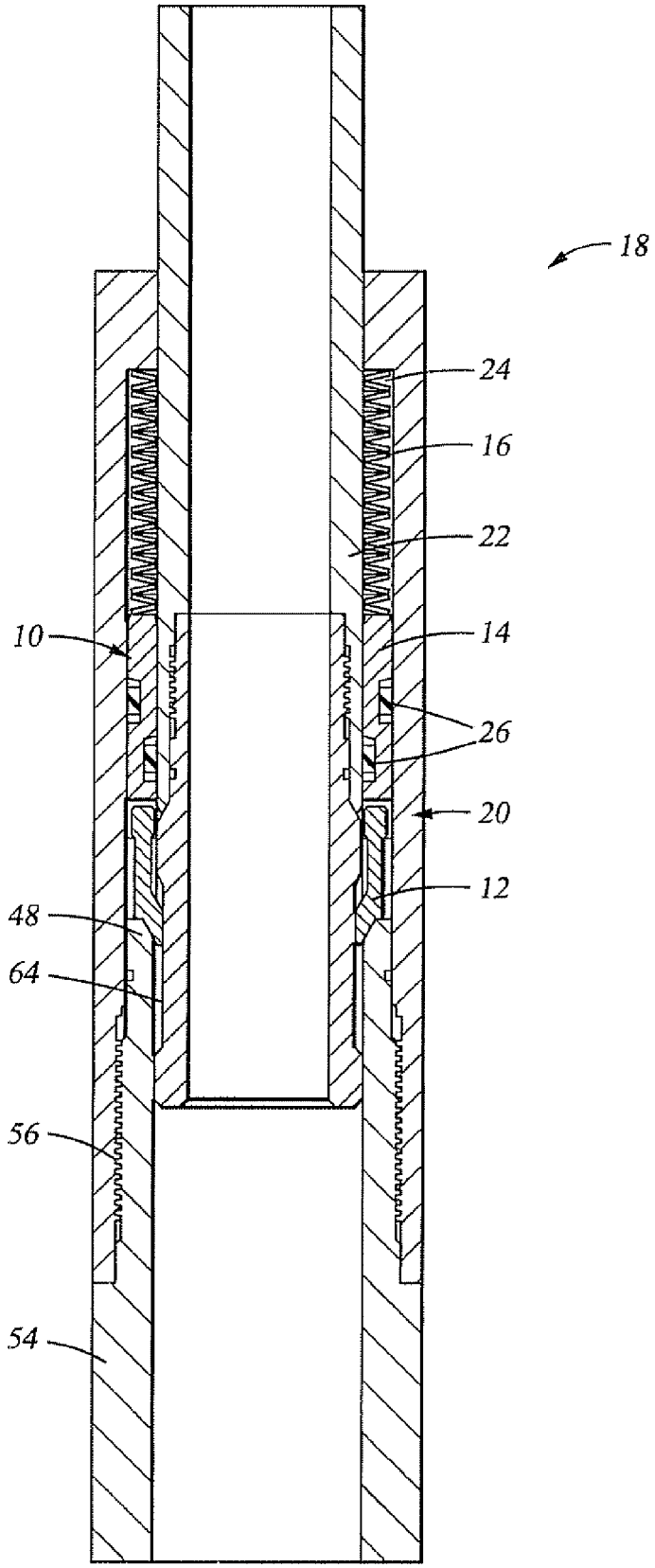
FIG. 1 is partial sectional view of one embodiment of a locking assembly.

In the description that follows, like parts are marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to those embodiments illustrated and described herein. It is to be fully recognized that the different teachings of the embodiments discussed below may be employed separately or in any suitable combination to produce the desired results.

In particular, various embodiments of the present invention provide a number of different methods and apparatus for providing a locking engagement preventing axial movement between two bodies. The concepts of the invention are discussed in the context of a hydraulic drilling jar, but the use of the concepts of the present invention is not limited to this particular application and may be applied in other linearly acting mechanisms operating in a pressurized environment. Thus, the concepts disclosed herein may find application in other downhole tool applications, as well as in other hydraulically actuated components, both within oilfield technology and other technologies to which the concepts of the current invention may be applied.

In the context of the following description, up and down indicate directions relative to a wellbore, where the top of the well is at the surface. Although described as providing a locking engagement preventing downward movement, the embodiments described herein could easily be converted for use in preventing upward movement, or any relative axial movement between two bodies. Horizontal refers to an orientation that is perpendicular to the central axis of the wellbore or downhole tool. Vertical refers to an orientation parallel to the central axis of the wellbore or tool.

Referring now to FIG. 1, a partial sectional view of locking mechanism 10 is shown as installed in tool 18, which may, for example, be a hydraulic drilling jar. Locking mechanism 10 includes lock segments 12, piston 14, and biasing springs 16. Locking mechanism 10 is installed in tool 18 that includes body 20 and sleeve 22. When tool 18 is actuated, sleeve 22 moves downward relative to body 20. Sleeve 22 fits concentrically inside body 20 and forms annular cavity 24 there between. Springs 16 are contained within cavity 24 and seals 26 form a seal between piston 14 and the walls of annular cavity 24 formed by sleeve 22 and body 20, isolating cavity 24 from hydrostatic pressure within tool 18.

Figure 2:
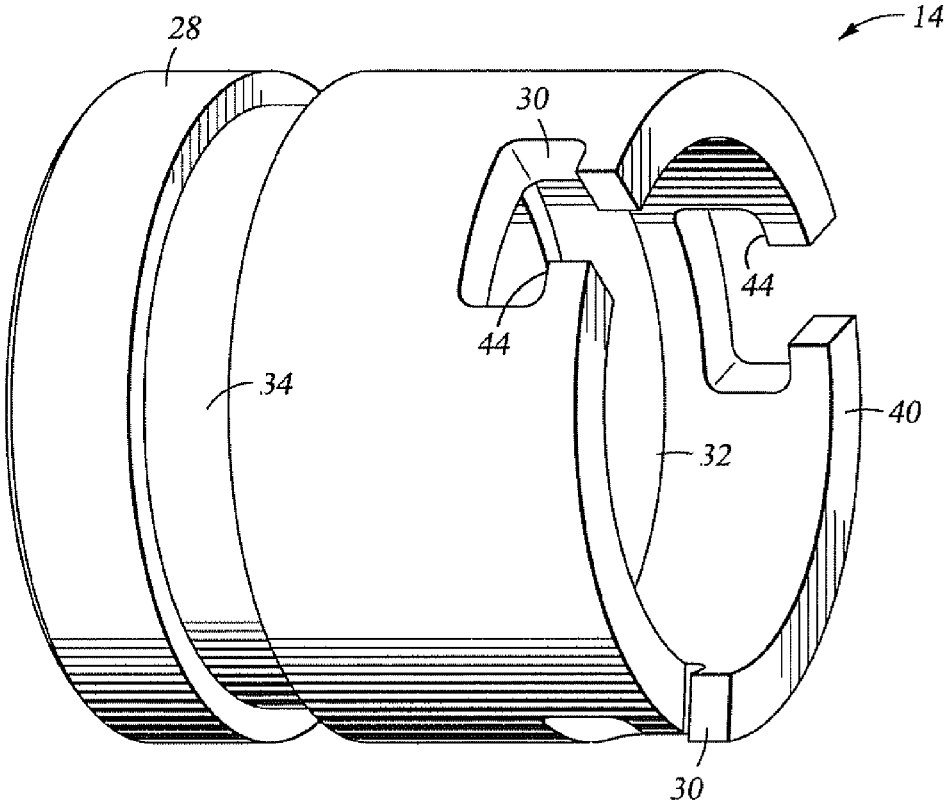
FIG. 2 is an isometric view of one embodiment of a lock piston.
Figure 3:
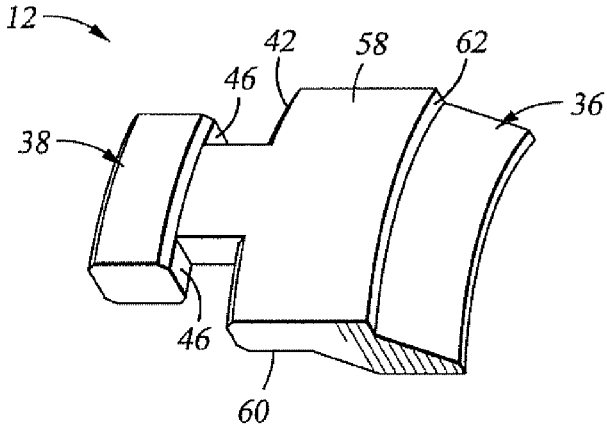
FIG. 3 is an isometric view of one embodiment of a lock segment.
Figure 4:
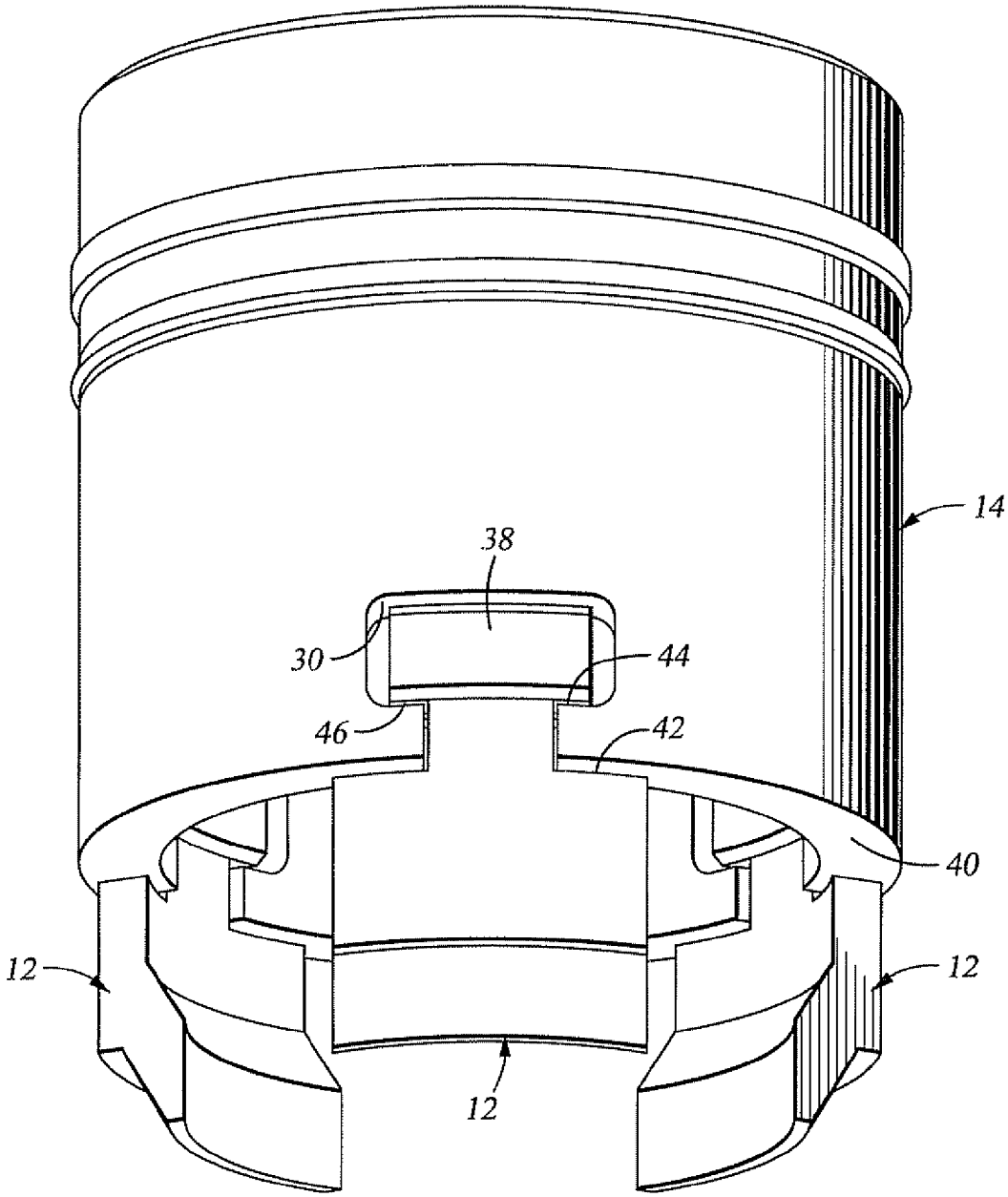
FIG. 4 is an isometric view of the lock segment of FIG. 3 installed in the lock piston of FIG. 2.

Referring now to FIG. 2, an isometric view of piston 14 is shown. Piston 14 comprises a cylindrical body 28 having a piston face 40, three T-shaped slots 30 on one end, groove face 44, internal seal groove 32, and external seal groove 34. FIG. 3 shows a lock segment 12 having wedged-shaped locking head 36 and a T-shaped tail 38. Locking head 36 includes an outer convex surface 58, an inner concave surface 60, load face 42, tail face 46, and a flat bearing surface 62. As can be seen in FIG. 4, tail 38 loosely engages slot 30 to connect lock segment 12 to piston 14. Lock segment 12 and slot 30 are sized to that when piston 14 is pushing downward against lock segment 12, the force is transferred from piston face 40 into the load face 42. When piston 14 is pulling back on a lock segment 12, groove face 44 pulls on tail face 46. Lock segment 12 is sized so that it can move radially with respect to piston 14 as the lock mechanism 10 engages and disengages.

Figure 5:
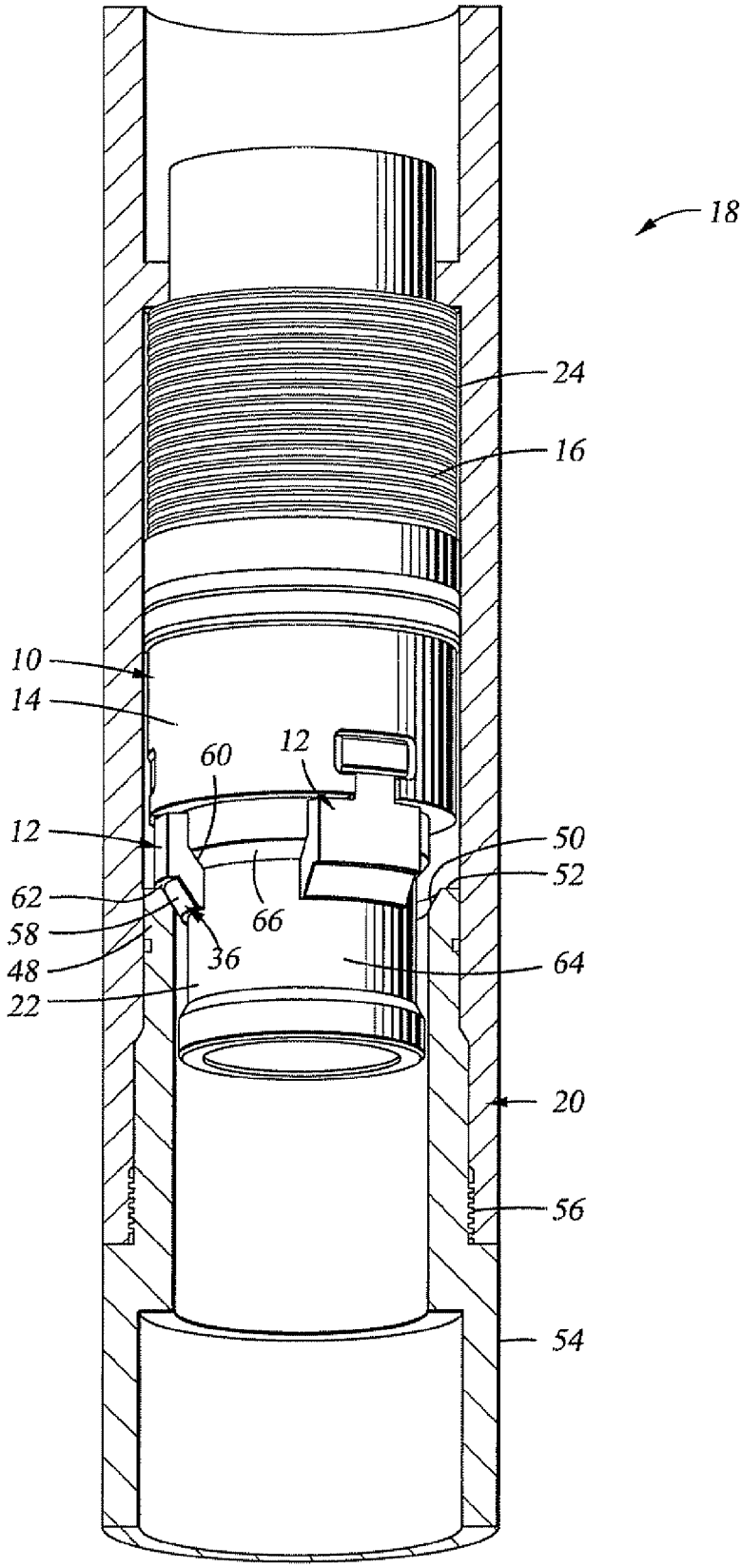
FIG. 5 is a partial sectional isometric view of one embodiment of a lock assembly in the locked position.

Referring now to FIG. 1 and FIG. 5, locking mechanism 10 is shown in a locked position with tool 18 in an open position. Springs 16 push piston 14 downward, which pushes lock segments 12 downward until they engage body shoulder 48. Body shoulder 48 includes concave cone face 50 and flat face 52. Body shoulder 48 may be integral with body 20 but is preferably formed on one end of body insert 54, which is connected to body 20 by threads 56 after piston 14 is installed.

Lock segments 12 engage body shoulder 48, with convex surface 58 seating on concave face 50, and with bearing surface 62 seating on face 52, to place the lock segments 12 into a locked position. In the locked position, locking head 36 extends radially inward and beyond the inside diameter of body 20 and into counterbore 64 on sleeve 22. Counterbore 64 includes shoulder 66 that, as sleeve 22 is moved downward relative to body 12, engages concave surface 60 and is prevented from further downward relative movement.

Referring still to FIG. 1 and FIG. 5, shoulder 66 of sleeve 22 and concave surface 60 of lock segment 12, preferably extend at an angle less than 45 degrees from horizontal such that the majority of the force applied by sleeve 22 onto lock segments 12 is projected downward through the lock segments 12. The downward projected force carries through bearing surface 62 of lock segment 12 onto face 52 of body 20. Any horizontally directed loads are directed from convex surface 58 onto concave face 50. Once lock segments 12 are engaged, they cannot be moved radially, thus providing a positive locking engagement between body 20 and sleeve 22 that will not be disengaged by increasing loads from sleeve 22. The load created by the downward movement of sleeve 22 is carried in shear across each locking segment 12, which individually and collectively are capable of carrying significant loads.

Figure 6:
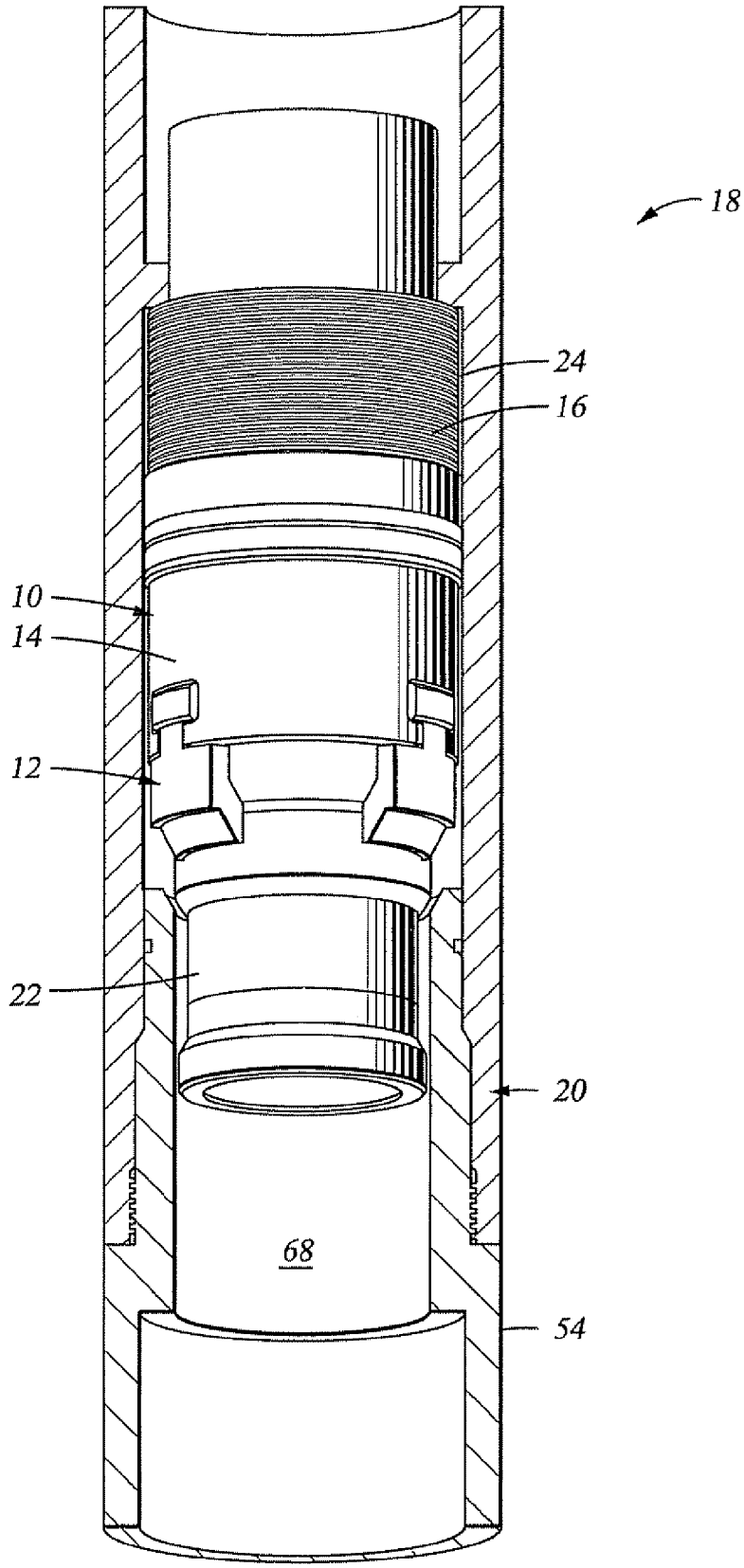
FIG. 6 is a partial sectional isometric view of the lock assembly of FIG. 5 in the unlocked position.

Referring now to FIG. 6, the locking mechanism 10 is unlocked by hydrostatic pressure in the interior 68 of tool 18. Cavity 24 is hydraulically isolated from the interior 68. As hydrostatic pressure in interior 68 increases, such as when tool 18 is being run into a well, the pressure acting on piston 14 creates a force that, once the hydrostatic pressure reaches a predetermined level, overcomes the force generated by springs 16, compresses the springs and pushes piston 14 back into cavity 24. Lock segments 12 are retracted by piston 14 and are moved into an unlocked position where sleeve 22 can move axially with respect to body 20. As the hydrostatic pressure in tool interior 68 decreases, such as when tool 18 is being pulled from a well, springs 16 will push piston 14 and lock segments 12 back into the locked position.

Springs 16 may be any type of spring, including a series of flat springs, such as Belleville washers, a coil spring, or a hydraulic spring. The spring can be chosen so that the lock mechanism 10 will engage and disengage at a certain pressure force acting on the piston. This pressure force is directly dependent on the depth of the tool in the wellbore. Therefore, a spring system 16 can be chosen so as to set the depth within the wellbore at which the locking mechanism 10 will unlock when the tool is run. This depth will also correspond to the depth at which the tool will reset when the pulled from the well.

Referring back to FIG. 1, locking assembly 10 may be used in any tool subjected to internal pressure, such as when lowered into a wellbore. One particular tool in which locking assembly 10 may find application is drilling jars. In an exemplary installation in a hydraulic drilling jar, sleeve 22 is a washpipe and is maintained in a full open position by lock assembly 10. The lock assembly 10 is preferably installed such that when the jar is in tension (such as when being run into the well), the washpipe is slightly above engagement with the lock assembly, but when any compressive force is applied to the jar, the washpipe will engage the lock assembly, if the assembly is in the locked position.

Lock assembly 10 is pushed into the locked position by springs 16 and retracted by wellbore pressure acting on springs 16. Thus, the lock assembly 10 will automatically unlock as the jar is being run and automatically lock as the jar is retrieved from the well. This automatic locking and unlocking eliminates the need for any positive action by rig floor personnel to secure the jar once it is retrieved from the well. Because lock assembly 10 also provides a positively engaged lock, there is no need for additional, external locking equipment to secure the jar.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A locking apparatus comprising:

an outer body;

a sleeve slidably disposed within said outer body;

a annular cavity formed between said outer body and said sleeve;

a piston sealingly engaging said cavity;

a plurality of lock segments connected to said piston, wherein said lock segments have a first position preventing said sleeve from axially translating in at least one direction relative to said outer body and a second position allowing axial translation; and a spring disposed within said cavity so as to bias said piston and lock segments to the first position, wherein said lock segments are moved to the second position by pressure within said outer body.

2. The locking apparatus of claim 1 wherein said cavity is maintained at ambient pressure.

3. The locking apparatus of claim 1 further comprising a shoulder disposed on said sleeve that engages a concave surface on said lock segments when said lock segments are in the first position.

4. The locking apparatus of claim 3 wherein said shoulder and said concave surface are at an angle of 45 degrees or less from horizontal.

5. The locking apparatus of claim 3 wherein said lock segments further comprise a bearing surface that seats on a face disposed on said outer body.

6. The locking apparatus of claim 5 where said bearing surface and face are horizontal.

7. The locking apparatus of claim 1 wherein said plurality of springs are belleville springs.

8. The locking apparatus of claim 1 wherein said plurality of lock segments comprises at least three lock segments.

9. A downhole tool comprising:

a body:

a sleeve disposed within said body and axially translatable relative to said body:

a locking mechanism having a locked position preventing axial translation of said sleeve relative to said body, wherein said locking mechanism comprises a piston disposed in a cavity formed by said body and said sleeve, and wherein said piston sealingly engages the cavity and the cavity is maintained at ambient pressure; and a spring biasing said locking mechanism to the locked position, wherein said locking mechanism is unlocked by hydrostatic pressure within said tool.

10. A downhole tool comprising:

a body:

a sleeve disposed within said body and axially translatable relative to said body;

a locking mechanism having a locked position preventing axial translation of said sleeve relative to said body, wherein said locking mechanism comprises a piston disposed in a cavity formed by said body and said sleeve, and wherein said locking mechanism comprises a plurality of lock segments connected to said piston; and a spring biasing said locking mechanism to the locked position, wherein said locking mechanism is unlocked by hydrostatic pressure within said tool.

11. The downhole tool of claim 10 wherein said plurality of lock segments comprises at least three lock segments.

12. The downhole tool of claim 10 further comprising a shoulder disposed on said sleeve that engages a concave surface on said lock segments when said lock segments are in the locked position.

13. The downhole tool of claim 12 wherein said shoulder and said concave surface are at an angle of 45 degrees or less from horizontal.

14. The downhole tool of claim 12 wherein said lock segments further comprise a bearing surface that seats on a face disposed on said outer body when said lock segments are in the locked position.

15. The downhole tool of claim 14 where said bearing surface and face are horizontal.

16. A downhole tool comprising:

a body:

a sleeve disposed within said body and axially translatable relative to said body;

a locking mechanism having a locked position preventing axial translation of said sleeve relative to said body; and a spring biasing said locking mechanism to the locked position, wherein said spring comprises a plurality of belleville springs, and wherein said locking mechanism is unlocked by hydrostatic pressure within said tool.

17. A tool comprising:

a drilling jar comprising an outer body and an inner sleeve that translates axially relative to the outer body; and a locking mechanism disposed on said drilling jar and having a locked position preventing the axial translation of the inner sleeve in at least one direction and an unlocked position where axial translation is allowed, wherein said locking mechanism comprises a spring that biases said locking mechanism to the locked position and a piston that moves said locking mechanism to the unlocked position in response to pressure within said drilling jar.

18. The tool of claim 17 wherein said locking mechanism comprises a piston disposed in a cavity formed by the outer body and the inner sleeve.

19. The downhole tool of claim 18 wherein said piston sealingly engages the cavity and the cavity is maintained at ambient pressure.

20. The downhole tool of claim 18 wherein said locking mechanism further comprises a plurality of lock segments connected to said piston.

21. The downhole tool of claim 20 wherein said plurality of lock segments comprises at least three lock segments.

22. The downhole tool of claim 20 further comprising a shoulder disposed on said sleeve that engages a concave surface on said lock segments when said lock segments are in the locked position.

23. The downhole tool of claim 22 wherein said shoulder and said concave surface are at an angle of 45 degrees or less from horizontal.

24. The downhole tool of claim 22 wherein said lock segments further comprise a bearing surface that seats on a face disposed on said outer body when said lock segments are in the locked position.

25. The downhole tool of claim 24 where said bearing surface and face are horizontal.

26. The downhole tool of claim 17 wherein said plurality of springs are belleville springs.

27. A drilling jar comprising:

a cylindrical body having and inner surface;

a sleeve slidably disposed within said cylindrical body and having an outer surface;

an annular chamber formed by the inner surface of said cylindrical body and the outer surface of said sleeve;

a piston slidably disposed in said annular chamber and sealingly engaging the inner surface of said cylindrical body and the outer surface of said sleeve, wherein said piston has first and second ends;

a plurality of apertures in said piston and including openings to the second end;

a plurality of lock segments having an interface portion adapted to engage said apertures and an extending portion comprising a locking head;

a spring disposed within said chamber and adapted to provide a force to the first end of said piston so as to bias said piston to a locked position wherein the locking heads of said plurality of lock segments prevent said sleeve from sliding relative to said body in one direction.

28. The drilling jar of claim 27, wherein in the locked position the locking head extends radially inside the outer surface of said sleeve.

29. The drilling jar of claim 27, further comprising:

a convex surface and a bearing surface on the locking head; and a shoulder having a concave face and a flat face disposed on said body, wherein in the locked position the convex surface seats on the concave surface and the bearing surface seats on the flat face.

30. The drilling jar of claim 27 wherein said plurality of apertures and the interface portion of said locking segments are T-shaped.

* * * * *